US006257853B1

(12) United States Patent
White

(10) Patent No.: US 6,257,853 B1
(45) Date of Patent: Jul. 10, 2001

(54) HYDRAULIC MOTOR WITH PRESSURE COMPENSATING MANIFOLD

(75) Inventor: Jeffrey Neil White, Hopkinsville, KY (US)

(73) Assignee: White Hydraulics, Inc., Hopkinsville, KY (US)

( * ) Notice: Subject to any disclaimer, the term of this patent is extended or adjusted under 35 U.S.C. 154(b) by 0 days.

(21) Appl. No.: 09/585,775

(22) Filed: Jun. 5, 2000

(51) Int. Cl.[7] ..... F01C 1/10; F03C 2/08
(52) U.S. Cl. ..... 418/61.3; 418/77; 418/187
(58) Field of Search ..... 418/61.3, 77, 186, 418/187

(56) References Cited

U.S. PATENT DOCUMENTS 3,532,447 * 10/1970 Charlson ..... 418/61.3
4,474,544 * 10/1984 White, Jr. ..... 418/61.3
4,717,320 * 1/1988 White, Jr. ..... 418/61.3
4,741,681 * 5/1988 Bernstrom ..... 418/61.3
4,976,594 * 12/1990 Bernstrom ..... 418/61.3

OTHER PUBLICATIONS

Eaton Promotional Material, dated prior to applicant's invention.*

* cited by examiner

*Primary Examiner*—John J. Vrablik
(74) *Attorney, Agent, or Firm*—Lightbody & Lucas

(57) ABSTRACT

A pressure compensating manifold for a gerotor device having a manifold with bidirectional valving passages and a passage selectively connecting as least one of such bidirectional passages to a chamber behind the manifold so as to pressure equalize the gerotor structure.

48 Claims, 7 Drawing Sheets

HYDRAULIC MOTOR WITH PRESSURE COMPENSATING MANIFOLD

BACKGROUND OF THE INVENTION

Hydraulic pressure devices are both mechanically and volumetrically efficient at producing high torque from relatively compact devices. Their ability to provide low speed and high torque make them adaptable to numerous applications. However, their cost and complexity make them relatively expensive, thus unsuitable from a business standpoint for certain applications. The present invention of a hydraulic motor pressure compensating manifold alleviates a number of these business concerns.

DESCRIPTION OF THE PRIOR ARTS

Hydraulic motors are well known in the art. Examples include the rotating valve devices manufactured by Eaton Corporation, the orbiting valve devices manufactured by Parker-Hannifin, and other devices including those made by the assignee of the present application, White Hydraulics. The motors themselves typically have complicated housing parts necessitating numerous machining, drilling and other secondary operations in order to manufacture the unit. Each of these additional manufacturing steps adds the complexity of the hydraulic motor, increasing the cost of manufacture, maintenance and others attendant to the motors.

In instant respect to the present invention, a hydraulic motor pressure compensating manifold, previous attempts directed at balancing a motor include White U.S. Pat. No. 4,717,320 issued Jan. 5, 1998, White U.S. Pat. No. 4,474, 544 issued Oct. 2, 1984 and Eaton U.S. Pat. No. 4,976,594 issued Dec. 10, 1990. Each of these motors is, however, sufficiently expensive that they are not suitable for relatively low cost low force applications like wheel drives for lawn maintenance mowers and other applications which include factors driven by the cost of the hydraulic motor.

The present invention is designed to simplify the construction of hydraulic motors and more particularly hydraulic motors having a pressure compensating mechanism.

OBJECTS AND SUMMARY OF THE INVENTION

It is an object of the present invention to simplify the construction of hydraulic motors.

It is another object of the present invention to increase the volumetric and mechanical efficiency of hydraulic motors.

It is another object of the present invention to lower the cost of hydraulic motors.

It is yet another object of the present invention to increase the adaptability of hydraulic motors.

Other objects of the invention and a more complete understanding of the invention may be had referring to the drawings in which:

DETAILED DESCRIPTION OF THE INVENTION

Figure 1:
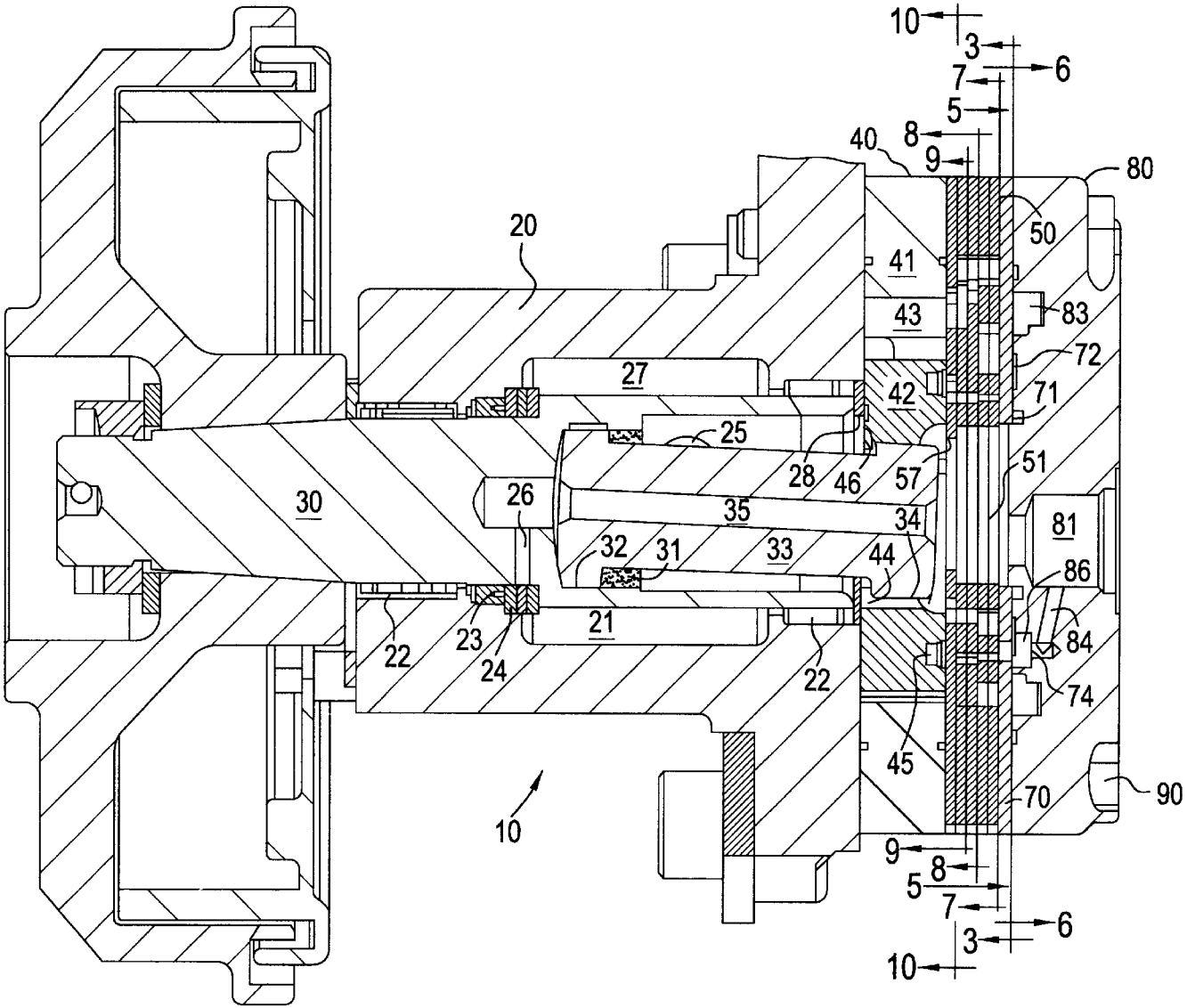
FIG. 1 is a longitudinal cross-sectional view of a hydraulic motor incorporating the invention of the present application.
Figure 2:
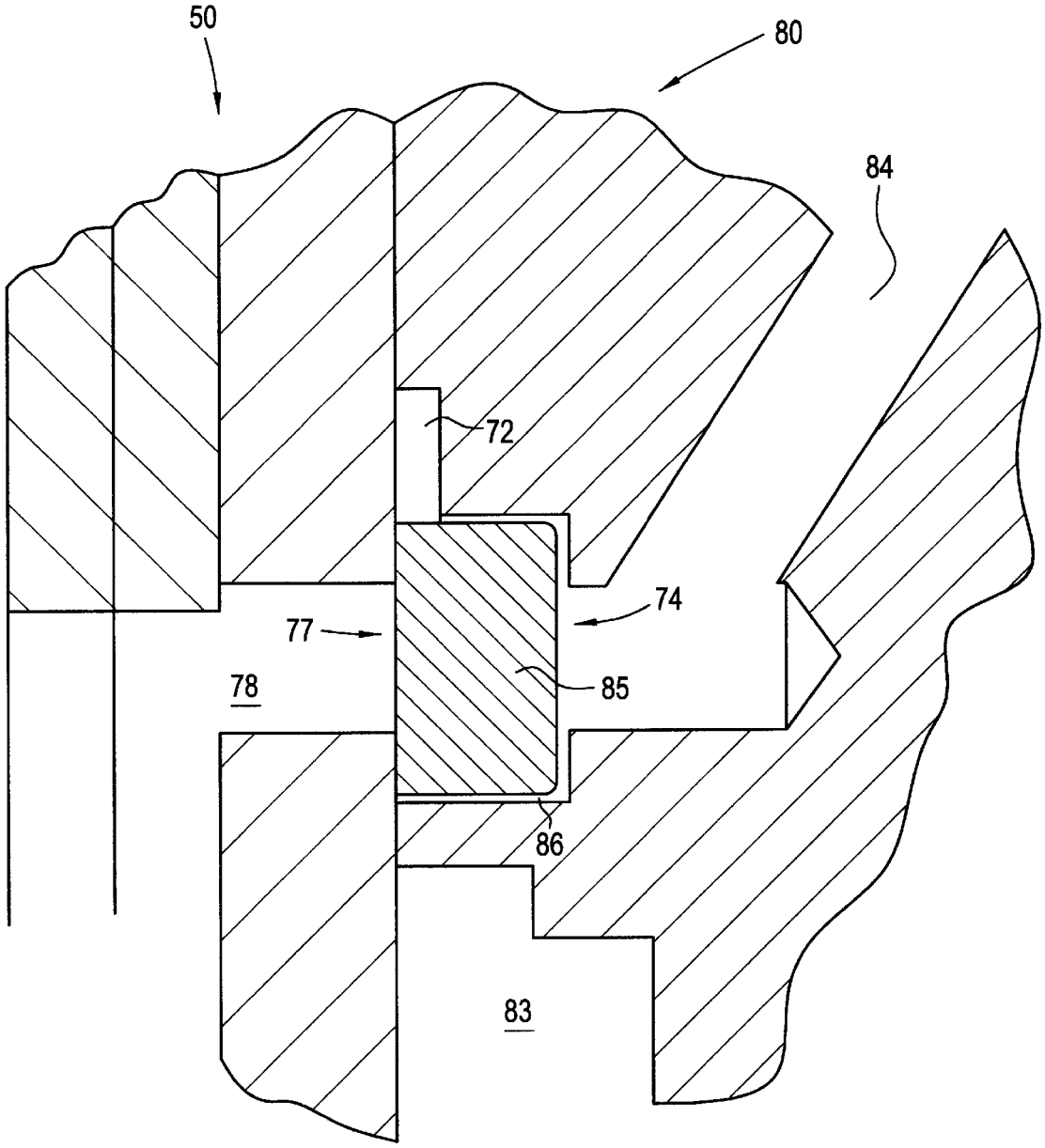
FIG. 2 is an enlarged view of the unitary pressurization valve of FIG. 1.
Figure 3:
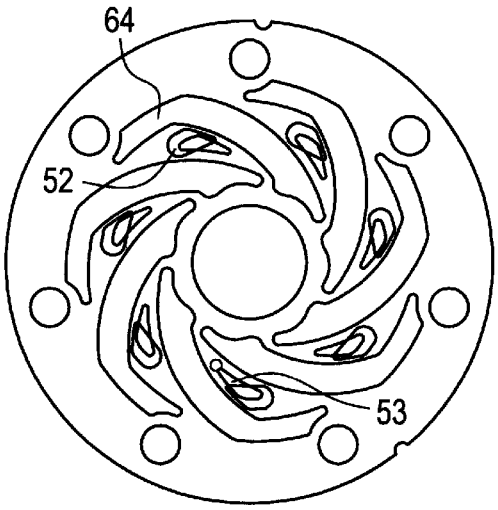
FIG. 3 is an X-ray view of the pressure compensating plate of FIG. 5 over the manifold plate of FIG. 7 taken along lines 3—3 of FIG. 1 detailing the location of the check valves for the pressure compensating chamber.
Figure 4A:
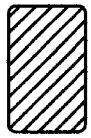
FIG. 4A is a cutaway side view of the valving disk of FIG. 2.
Figure 4B:
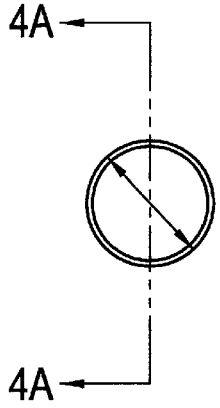
FIG. 4B is a top view of the same valving disk of FIG. 2.
Figure 5:
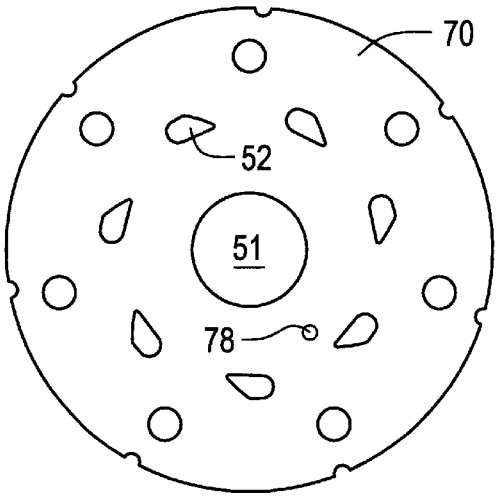
FIG. 5 is a side view of the pressure compensating plate taken along lines 5—5 of FIG. 1.
Figure 6:
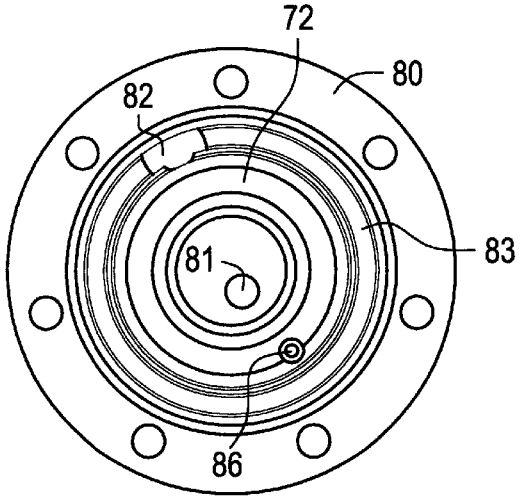
FIG. 6 is a manifold side view of the end port plate of the motor of FIG. 1 taken generally along lines 6—6 therein.
Figure 7:
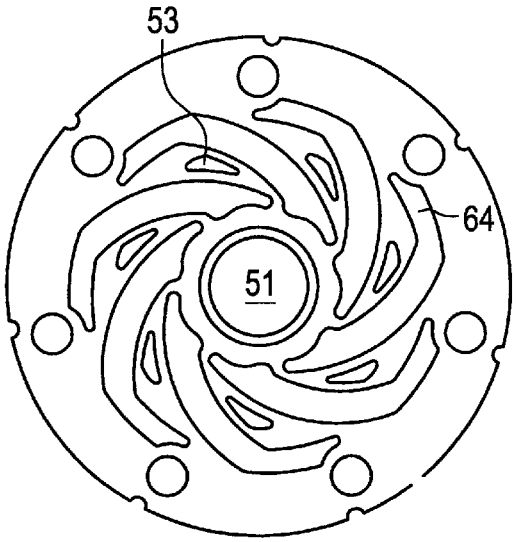
FIGS. 7–10 are sequential views of the individual plates that make up the pressure compensating manifold of FIG. 1 taken generally along lines 7—7 to 10—10 therein.
Figure 8:
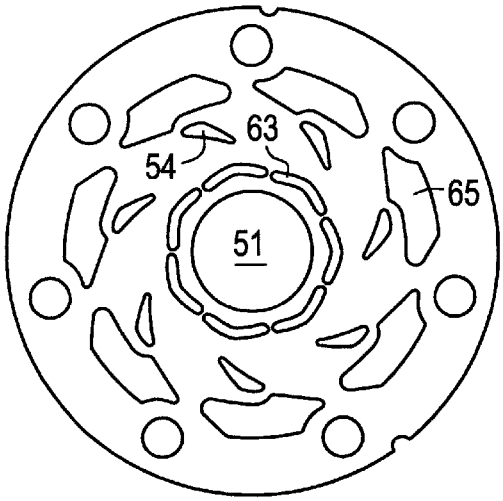
Figure 9:
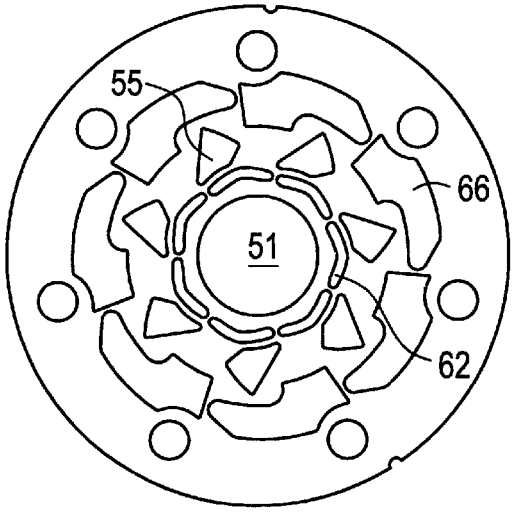

This invention relates to an improved hydraulic pressure device with a pressure compensating manifold.

The invention will be described in its preferred embodiment of the gerotor motor having an orbiting valve integral with the rotor of the gerotor structure.

A gerotor pressure device 10 includes a bearing section 20, a gerotor structure 40, the pressure compensating manifold 50 and the end port plate 80.

The bearing section 20 serves to physically support and locate the driveshaft 30 as well as typically mounting the gerotor pressure device 10 to its intended use such as a mower, winch or other application.

The particular bearing section 20 of FIG. 1 includes a central cavity 21 having two needle bearings 22 rotatively supporting the driveshaft 30 therein. A shaft seal 23 is incorporated between the bearing section and the driveshaft in order to contain the operative hydraulic fluid within the device. A thrust bearing 24 located immediately adjacent the seal 23 serves to prevent the extruding of the driveshaft from the bearing section 20 as well as providing some axial support for the rotor of the later described gerotor structure 40. A series of radial holes 25 throughout the driveshaft and a smaller radial hole 26 through the head of the driveshaft allow for the circulation of fluid through the central cavity including across the thrust bearing 24. This cools and lubricates moving parts as well as the wobblestick teeth drive connections.

The driveshaft 30 serves to interconnect the later described gerotor structure 40 to the outside of the pressure device. This allows rotary power to be generated (if the device is used as a motor) or fluidic power to be produced (if the device is used as a pump).

The driveshaft includes a centrally located hollow 27 which has internal teeth 31 therein, which teeth interconnect to corresponding teeth 32 on the wobblestick 33 so as to drivingly interconnect the driveshaft with such wobblestick. Additional teeth 34 on the other end of the wobblestick drivingly interconnect the wobblestick 33 to the rotor of the later described gerotor structure, thus completing the power generating drive connection from the device. A central hole 35 extending through the longitudinal axis of the wobblestick further facilitates fluid communication through and about the driveshaft 30 and wobblestick 33.

The gerotor structure 40 is the main power generation apparatus for the pressure device 10. The particular gerotor structure 40 disclosed includes a stationary stator 41 and an orbiting rotor 42 which together define expanding and contracting gerotor cells 43. As these cells 43 are subjected to a varying pressure differential by the later described valve in the rotor 42, the power of the pressure device is generated. This occurs because the axis of rotation of the rotor is displaced from the central axis of the stator (the wobblestick accommodates this displacement). This valving is generally set forth in White U.S. Pat. No. 4,474,544, the contents at which are included by reference (the most pertinent figure in this '544 patent are FIGS. 24–34).

The main structural difference between the gerotor structure of the present application and those set forth in the '544 patent is that in the present invention, neither the teeth of opening 44 near the wobblestick (which serves as one port connection for the fluid valve) nor the outer circumferential ring 45 (which serves as the connection to the other port) extend full depth through the entire width of the rotor 42.

In respect to the inner opening 44, this allows for the creation of an inward extending edge 46 which cooperates with a thrust washer 28 to allow same to serve as an inward wear member between the rotor 42 and the driveshaft 30, transferring axial forces therebetween. This replaces the thrust bearing and wear plate typically found at this location. The extension of the thrust washer 28 under load is equal to the plane of the stator 41 to a maximum of the axial side clearance of the rotor 42 in respect to such stator (0.001 to 0.0015 typical). The washer 28 serves primarily to support any inward thrust on the driveshaft 30 without significantly compromising the mechanical efficiency of the device. As the thrust washer 28 rotates with the rotor 42 and driveshaft 30, the primary wear is that which is created by the slight orbital motion of the rotor 42 against the thrust washer 28. An actual thrust bearing (like 24) could be substituted for the thrust washer if desired.

Figure 13:
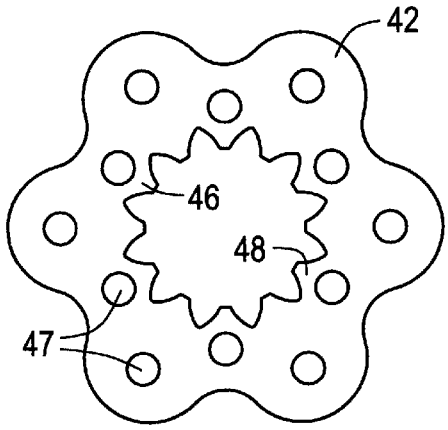
FIG. 13 is a drive shaft end view of the rotor of FIG. 11, slightly enlarged in respect to the other figures detailing the balancing holes for the device.
Figure 15:
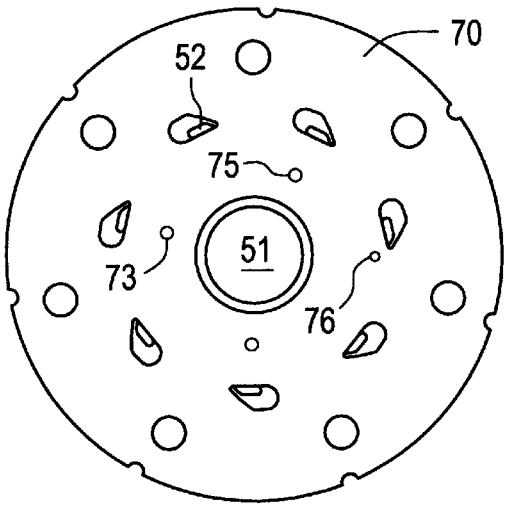
Figure 14:
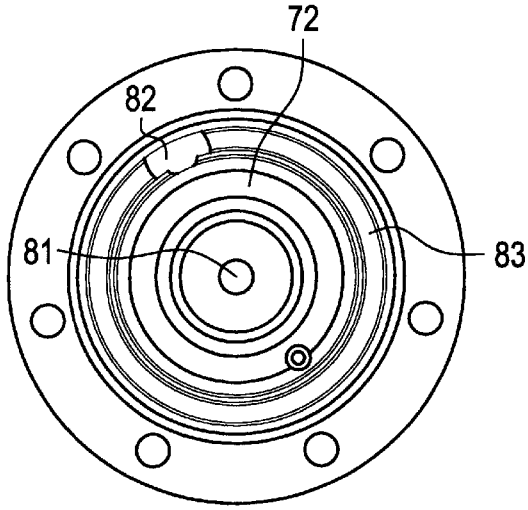
FIG. 14 is a manifold side view of the end port plate of the motor of FIG. 11 taken generally along lines 14—14 therein; and, FIGS. 15–19 are sequential views of the individual plates that make up the pressure compensating manifold of FIG. 1 taken generally along lines 15—15 to 19—19 therein.
Figure 16:
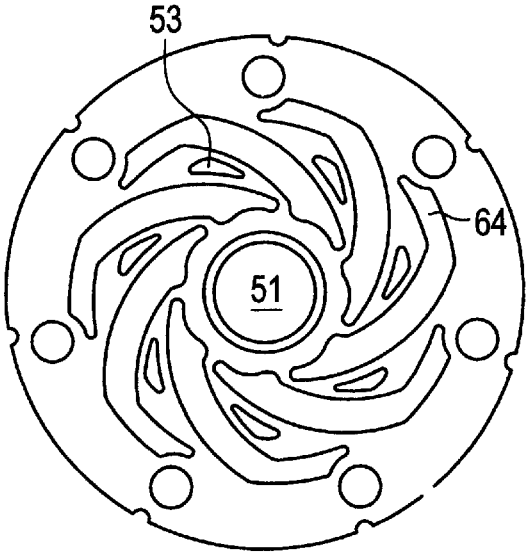
Figure 17:
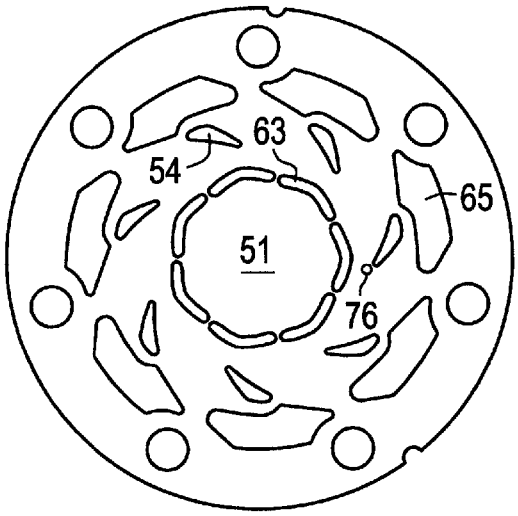
Figure 18:
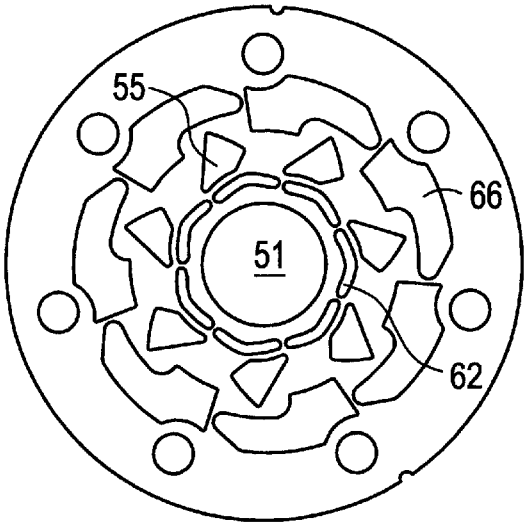
Figure 19:
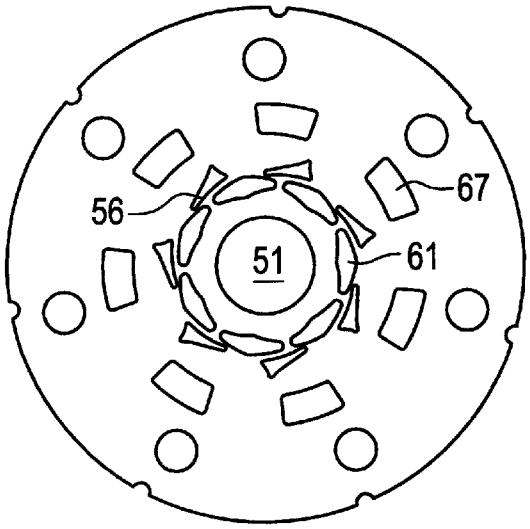

In respect to the outer opening 45, the fact that it does not extend all the way through the rotor 42 allows for a series of balancing holes 47 (FIG. 13) to be located on the drive shaft side of the rotor 42. When the central cavity 21 is at high pressure, these holes 47 are also pressurized as they sweep by such cavity 21. This aids in equalizing the pressure on both sides of the rotor 42 under this condition.

Figure 10:
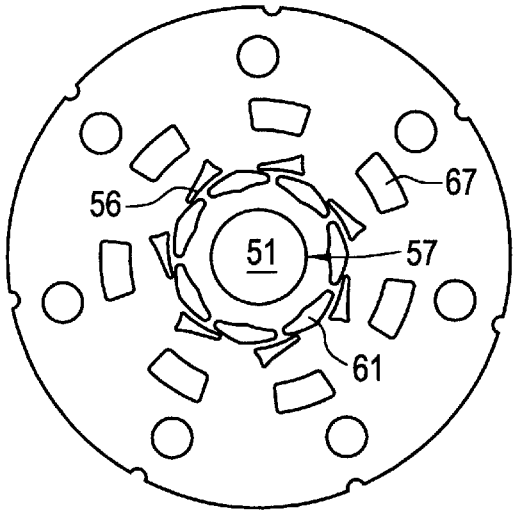
Figure 11:
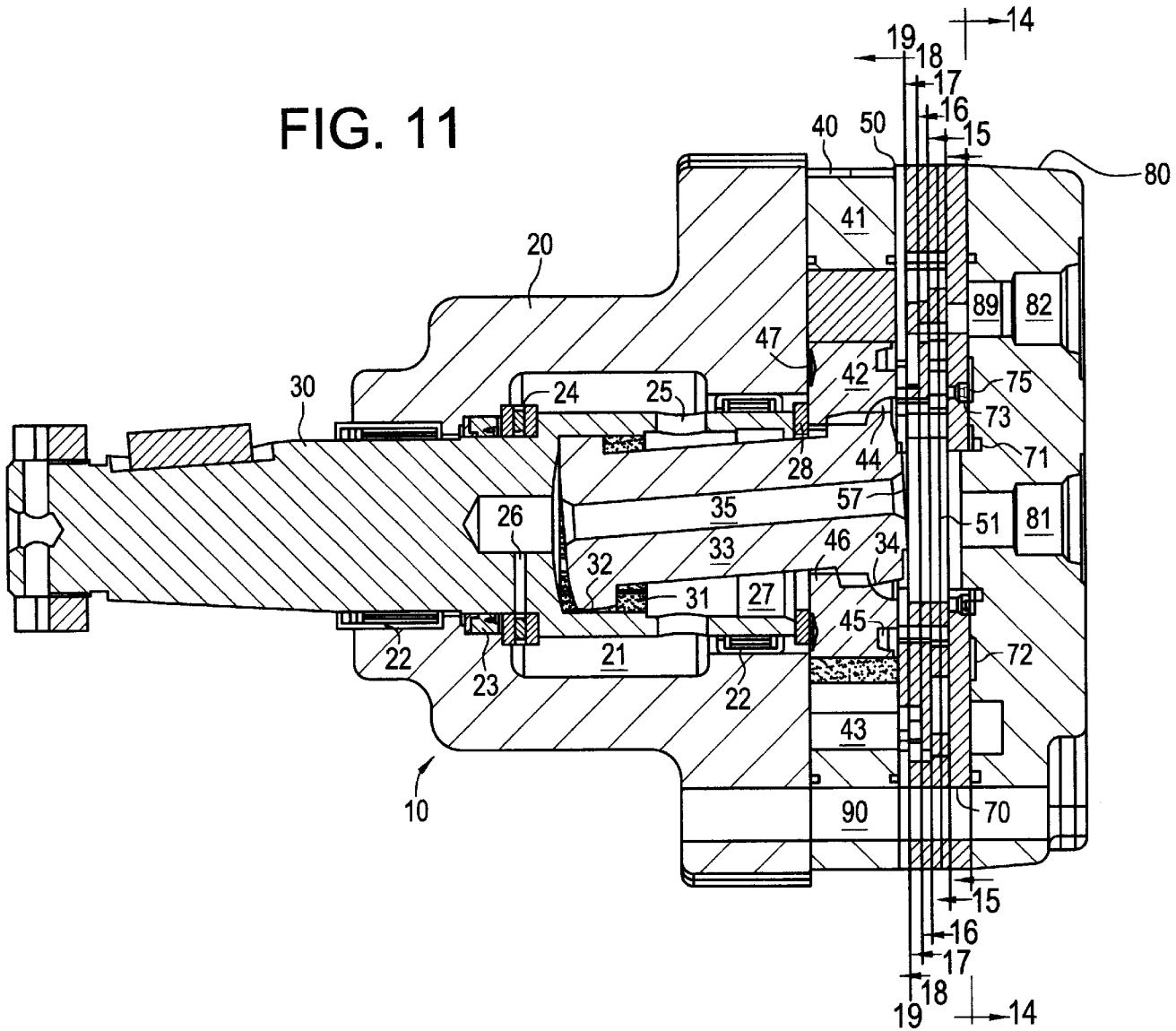
FIG. 11 is a longitudinal cross-sectional view of a hydraulic motor incorporating a second embodiment of the invention of the present application.

The particular holes 47 are 0.22" in diameter on an alternating 2.2" and 1.7" bolt circle. Note that the hole 51 in the center of the manifold 40 is stepped down in diameter from 1.2" to 1.0" at the plate (FIG. 10) immediately adjacent to the rotor 42. On any shifting of the wobblestick, this stepped section 57 will engage the axial end of the wobblestick 33 in an arc at the maximum displacement of this end, thus serving to retain the wobblestick in a single operative position in respect to the device 10.

The pressure compensating manifold 50 serves to selectively interconnect fluid from the two ports 81, 82 in the end port plate 80 to the expanding and contracting gerotor cells as the device is operated via the inner opening 44 and outer ring 45 respectively. The pressure compensating manifold in addition serves to provide for a more consistent loading of the rotor 42 in its operation, thus providing for a more consistent operation as well as allowing the activation of this function at a lower pressure differential than otherwise.

The particular valving fluid section of the manifold of the preferred embodiment is of brazed multiplate construction in the manner taught by White U.S. Pat. No. 4,697,997, the contents of which are included by reference. Other means such as glue, adhesives, sealants, integral casting, or formation, etc. could also be used to connect the plates.

The fluid from one port 81 passes directly through a hole 51 in the center of the pressure compensating manifold in order to interconnect the port 81 with the circular inner opening 44 in the center of the rotor 42. This provides a flow of commutation fluid from one port to the rotor 42, which rotor also serves as a valve in the disclosed embodiment.

The fluid from the other port 82 passes through a circular annullus 83 in the port plate and thence through a series of passages in the pressure compensating manifold in order to connect such port 82 to the outer circular passageway 45 in the rotor 42. This series of passages 52–56 thus provides for a continual commutation of fluid between the port 82 and the outer passageway 45 in the rotor, thus providing the necessary fluid commutation from the other port to the other part of the valving section of the rotor 42. Note that this series of passages includes a passage 52 in the pressure compensating plate. This is preferred for the reduction in parts it allows.

It is further preferred that as many of the individual plates of the manifold are the same as that used in other models and variations of a given manufacturer's product line, thus to reduce dye costs, inventory costs, manufacturing costs, replacement costs, etc.

As the rotor 42 orbits about the gerotor structure 40 such rotor selectively interconnects the circular inner opening 44 or the circular outer passageway 45 to bidirectional valving openings in the pressure compensating manifold 50, thus providing the critical valving functioning for the device 10.

The bidirectional valving is provided by a series of passages 61–67 that extend through the manifold 50 to interconnect inner valving openings 61 to the outer gerotor cell openings 67. These passages 61–67 are selectively connected to either the pressure or return port by orbiting rotor valving. The manner of this valving is known in the art as that present in the White Model RE Motor, and described in U.S. patents including the previously mentioned U.S. Pat. No. 4,717,320 and U.S. Pat. No. 4,474,544 (the contents of which are included by reference in this application).

The functioning of this device 10 is different than that of the White Model RE Motor through the inclusion of a integral pressure compensating plate 70 in the manifold 50. In the embodiment disclosed, the primary difference between a White rear end ported single surface valving and commutation relative to the manifold and the manifold described herein is the later described hole 78 and a slight modification in thickness of the plate 70 including such hole so as to allow slightly more or less flexing as desired. In the embodiment, slightly more flexing is appropriate so as to compensate better for the outer valving groove 45. This pressure compensating plate 70 extends surrounding the hole 51 in the manifold directly between the manifold 50 and the port plate 80. A center area coextensive with the hole 51 is open with a circular seal 71 isolating the pressure compensating chamber 72 from the fluid within the hole 51. The pressure compensating chamber 72 is itself connected to a source of high pressure. With a unidirectional hydraulic device, this could be a single source, internal or external.

With a bidirectional device (as shown in both embodiments), the internal connection should preferably be to both sources, thus to insure pressure interconnection no matter which port is pressurized.

In the embodiment of FIGS. 1–10, this connection is directly to the two unidirectional possible sources of high pressure via a single valve while in the embodiment of FIGS. 11–19, the connection is to the bidirectional valving passages in the manifold. The former is preferred for once the device is pressurized, the valve will remain seated for the entire length of a pressurized operation while in the latter, intermittent reseating will occur on the intermittent pressurization of the respective passages.

In the single disk valve embodiment, one valve seat 74 is connected directly to one port 81 via an angled passage 84 in the port plate 80 while the other opposing valve seat 77 is connected to an unidirectional passage 53 in the manifold 50 via a hole 78 in the pressure compensating plate. A small cylindrical disk 85 in a cylindrical cavity 86 in the port plate 80 seats on the valve seat 74, 77 having the lowest relative pressure, thus connecting the compensating chamber 72 continually to the port 81, 82 having the highest relative pressure. Upon depressurization of the device, the disk unseats so as to equalize the pressure in the chamber 72. (Note that the chamber 72 could be located in either end port plate 80 as disclosed and/or in the pressure compensating manifold 50.) Other valves could also be utilized. A location in the port plate 80 is preferred in order that the flexing strength and longevity of the pressure compensating plate 70 be predictable and not be compromised in any way.

In the embodiment of FIGS. 11–19, the pressure compensating chamber 72 itself is connected by at least one ball check valve 73 to the bidirectional valving passages in the manifold. As these bidirectional passages in the manifold would be subjected to alternating high and low pressures, the ball check valves 73 have the function of providing a source of pressurized fluid for the chamber 72.

Included in the pressure compensating plate 70 is a pressure relief hole 76, which hole serves to release the pressure in the pressure compensating chamber 73 upon the reduction of the operating pressure of the device 10 (i.e., when the device is changed to operating at 500 psi from 1500 psi) or on the depressurization of the device 10 (i.e., when the device 10 is not operating). This relief hole 76 is preferably connected to one of the set of valving passages 52–56 in the manifold 50. (This set of passages being accessible by simply drilling a hole axially in the manifold 50.) However any passage including the bidirectional passages or central opening could be utilized if desired and/or appropriate. (The bidirectional passages are not preferred due to the possibility that the particular passage utilized might be a null passage connected to neither port.) The particular pressure compensating chamber 72 disclosed is a circular groove extending 360° about the axis of the device 10. This is preferred for providing a uniform loading on the manifold 50 (and thus the rotor 42). Preferably the chamber 72 is located to substantially equalize both the inner and outer valving openings taking into consideration their relative surface areas and locations.

A slight outward bias is disclosed, compensated for by the holes 47 in the rotor. The particular chamber or groove 72 has a 1.75" inner diameter and a 2.34" outer diameter and is some 0.03" deep. An inner land of some 0.15" separates the chamber 72 from the seal 71 while a comparable outer land separates the chamber 72 from the annullus 83. This pressure compensates for a rotor 42 having balancing holes 47 and with a distance across valleys of 2.27" and a distance across lobes of 2.91", an inner opening 44 of a cutaway hole which hole has a diameter of 1.48" (substantially matching the major diameter 1.44" of the splines 48 engaging the wobblestick) and an outer opening 45 having an inner diameter of 1.88" and an outer diameter of 2.22".

In the unidirectional hydraulic device of FIGS. 1–10, the manifold 70 is substantially the same as in the White Model RE with a slight reduction in thickness (from 0.155" to 0.145") and with the addition of a 0.150" diameter hole (seat 77) substantially axially aligned with a 0.125" diameter opposing hole (seat 74) in the port plate 80. The cylindrical cavity 86 in the port plate 80 is 0.250" in diameter and 0.150" deep. The cylindrical disk 85 is made of brass some 0.245" in diameter and 0.130" thick.

Figure 12:
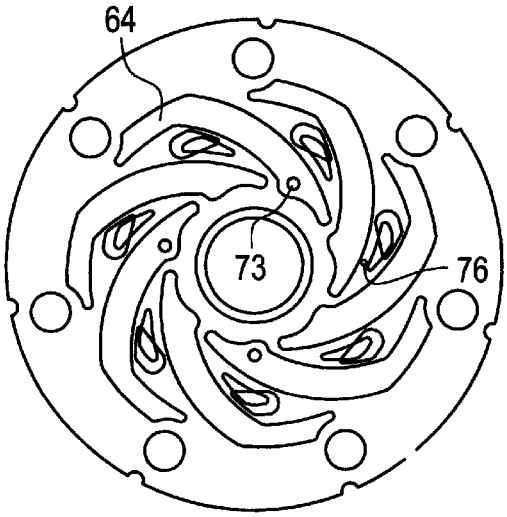
FIG. 12 is an X-ray view of the pressure compensating plate of FIG. 15 over the manifold plate of FIG. 16 detailing the location of the check valves for the pressure compensating chamber.

In the bidirectional device, each ball check valve 73 is a two diameter hole some 0.132" in diameter 0.095" deep in the compensating plate 70 on a 0.93 radius from the axis thereof with a further hole some 0.078" extending coaxially the rest of the way through the plate 70 (thus to interconnect with the underlying bidirectional passages 64 in the manifold 50 with such hole and thus the chamber 72; see FIG. 12). A ball 75 some 0.12" in diameter located in the 0.132" diameter section of the valve 73 completes same. The pressure relief hole 76 is a 0.063" diameter hole drilled some 0.5" deep on a 1.02" radius in the manifold 50 including plate 70, thus to interconnect the chamber 72 to passage 55 in FIG. 18 (and thus port 82). A small pin, some 0.5" in length and 0.061" in diameter rests in the relief hole 76, thus to reduce any loss in volumetric efficiency as the device 10 is operational while allowing controlled pressure release upon cessation of operation. It is preferred that this hole 76 extend through the lands of multiple plates (FIGS. 15, 16, 17) in order to properly position the pin therein, thus to provide consistent pressure control.

Note also that while it would be possible to include a separate seal between the chamber 72 and the annullus 83 interconnected to one port, it was discovered that the tightening pressures of the bolts 90 holding the device together was sufficiently high that no specific seals were necessary at this location (although they could be provided if desired). This is possible because the preferred plate 70 is the same diameter as the rest of the manifold 50.

It is preferred that the pressure compensating plate 70 be brazed to the pressure compensating manifold 50 in order to form an integral assembly. This strengthens the pressure compensating plate 70 while also allowing for a relatively flat and consistent pressure compensating operation without extensive bowing of the pressure compensating manifold.

It is further preferred that the thickness of the pressure compensating plate 70 be greater than the thickness of any individual plate in the manifold 50 (1.25 to 3 times preferred) while being a fraction of the thickness of the manifold without the plate 70 (0.20 or less preferred). This provides for a further uniform loading on the manifold 50. This reduces the possibility of manifold of delamination and/or uneven wear on the rotor.

In the preferred embodiment disclosed, the manifold 50 including the pressure compensating plate 70 is substantially 5" in diameter and 0.54" thick. Each individual plate in the manifold are substantially 0.075" to 0.1" thick. The pressure compensating plate 70 is 5" in diameter and 0.145" thick.

The port plate 80 serves to interconnect the device 10 to a source of pressure and return fluid in the manner previously described.

Although this invention has been described in its preferred form with a certain degree of particularity, numerous changes can be made without deviating from the following invention.

For example, if the center hole 51 in the manifold 50 were to be eliminated (for example moving port 81 to connect to the central cavity 21), the chamber 72 could be relocated and/or enlarged (inward mostly) to modify the pressurization equalization properties of the plate 70. Similarly, the relative thickness of the various plates of the manifold 50 could be altered to modify the same effect. Other changes are also possible without deviating from the claimed invention.

What is claimed:

1. A pressure compensating mechanism for a device including a housing and a manifold with a diameter, said mechanism comprising a plate, the diameter of said plate being substantially equal to the diameter of the manifold, said plate being brazed to the manifold, the outer extent of the manifold and said plate being fixed to the housing, and means to move said plate.

2. The mechanism of claim 1 wherein the device has a housing with a diameter and characterized in that the diameter of the manifold and said plate are substantially equal to the diameter of the housing.

3. The mechanism of claim 1 wherein the device is a hydraulic pressure device having unidirectional passages leading to pressure and return characterized in that said means to move said plate includes a passage connected to the unidirectional passage connected to pressure.

4. The mechanism of claim 3 wherein the device has a housing and characterized in that said passage is in the housing.

5. The mechanism of claim 3 wherein the device has a manifold and said passage is in the manifold.

6. The mechanism of claim 3 wherein the device has a manifold including bidirectional passages sequentially connected to pressure and return via a valve and characterized in that said passage is connected to the bidirectional passages via a one way valve unseating when the respective bidirectional passage is connected to pressure by the valve.

7. The mechanism of claim 6 wherein said passage is in the manifold.

8. The mechanism of claim 3 wherein the device is a hydraulic pressure device having unidirectional passages connected to two ports that may be either pressure and return and characterized in that said passage includes valved interconnection seat means connected to the two ports respectively to connect said passage to pressure.

9. The mechanism of claim 8 wherein the device has a manifold including bidirectional passages sequentially connected to pressure and return via a valve and characterized in that said passage is connected to the bidirectional passages via a one way valve unseating when the respective bidirectional passage is connected to pressure by the valve.

10. The mechanism of claim 1 wherein the manifold is a multiplate manifold and characterized in that the thickness of said plate is greater than the thickness of individual plates of the multiplate manifold.

11. The mechanism of claim 10 characterized in that said plate is 1.25 to 3 times as thick as the individual plates of the multiplate manifold.

12. The mechanism of claim 10 characterized in that said plate is less than 0.20 the total thickness of the multiplate manifold.

13. A pressure compensating mechanism connected to pressure and return for a hydraulic device having a housing, a manifold with a diameter, and unidirectional passages, said mechanism comprising a plate, said plate being located adjacent to the manifold adjoining another part of the device, the diameter of said plate being substantially equal to the diameter of the manifold, the outer extent of said plate and manifold being fixed to said another part, a chamber, said chamber being between said plate and said another part, and means to connect said chamber to the unidirectional passage connected to pressure.

14. The mechanism of claim 9 characterized in that the hydraulic device has bidirectional valving passages, and said means to connect said chamber to the unidirectional passage includes the bidirectional valving passages.

15. In a hydraulic device having single sided commutation to ports and valving to and from expanding and contracting cells through a manifold on a single side of a rotor, the improvement of a pressure compensating plate, said pressure compensating plate being on the same side of the rotor as the manifold, and the outer extent of said pressure compensating plate being fixed to the housing.

16. A pressure compensating mechanism for a hydraulic motor having a manifold fixed by its outer extent to the housing of such motor next to a gerotor structure, the housing including a unidirectional passage subject to relatively high pressure, a pressure compensating plate, said pressure compensating plate being located adjacent to the manifold and fixed by its outer extent to one or both of the housing and the manifold, said pressure compensating plate having a central axis, a chamber, said chamber being between adjacent said pressure compensating plate circumferentially surrounding said central axis, and passage means to fluidically connect said chamber to the unidirectional passage in the housing.

17. The pressure compensating mechanism of claim 16 characterized in that said chamber is a groove axially spaced from said central axis.

18. The pressure compensating mechanism of claim 16 wherein the manifold is a brazed multiplate manifold and characterized in that said pressure compensating plate is fixed to the manifold by brazing.

19. The pressure compensating mechanism of claim 16 characterized by the addition of pressure relief means to relieve the pressure in said chamber when the pressure in the unidirectional passage is reduced.

20. The pressure compensating mechanism of claim 16 characterized in that said passage means includes a check valve to retain the relatively high pressure in said chamber.

21. The pressure compensating mechanism of claim 20 wherein the device includes two unidirectional passages connected to pressure and return and characterized in that said check valve connects to the unidirectional passage having pressure.

22. The pressure compensating mechanism of claim 16 wherein the hydraulic motor includes first and second unidirectional ports that may be connected to pressure and characterized in that said passage means is connected via a check valve means to both the first and second ports.

23. The pressure compensating mechanism of claim 22 characterized in that one of the first and second unidirectional ports is in the housing.

24. The pressure compensating mechanism of claim 22 wherein the device includes bidirectional passages in the manifold connected to the first and second unidirectional ports via a valve and characterized in that said passage means connects to the bidirectional passages in the manifold.

25. A pressure compensating mechanism for a hydraulic motor having a manifold fixed to the housing of such motor next to a gerotor structure, the manifold including bidirectional valving passages occasionally subject to relatively high pressure and having a diameter substantially equal to that of the housing, a pressure compensating plate, said pressure compensating plate having a diameter, said diameter of said pressure compensating plate being substantially equal to the diameter of the manifold, said pressure compensating plate being fixed to the manifold, said pressure compensating plate having a central axis, a chamber, said chamber being adjacent said pressure compensating plate circumferentially surrounding said central axis on the opposite side of said plate from the manifold, and passage means to fluidically connect said chamber to the bidirectional valving passages.

26. The pressure compensating mechanism of claim 25 characterized in that said chamber is a groove axially spaced from said central axis.

27. The pressure compensating mechanism of claim 25 characterized in that said passage means includes a check valve to retain the relatively high pressure in said chamber.

28. The pressure compensating mechanism of claim 25 wherein the manifold is a brazed multiplate manifold and characterized in that said pressure compensating plate is fixed to the manifold by brazing.

29. The pressure compensating mechanism of claim 25 characterized by the addition of pressure relief means to relieve the pressure in said chamber when the pressure in the bidirectional passages is reduced.

30. The pressure compensating mechanism of claim 29 wherein the device includes unidirectional passages connected to a port and characterized in that said pressure relief means connects to a unidirectional passage.

31. A pressure compensating mechanism for a hydraulic motor having a manifold fixed to the housing of such motor next to a gerotor structure, the manifold including a unidirectional passage subject to relatively high pressure, the manifold having a diameter substantially equal to that of the housing, a pressure compensating plate, said pressure compensating plate having a diameter substantially equal to that of the manifold, said pressure compensating plate being fixed to the manifold on the opposite side from the gerotor structure, said pressure compensating plate having a central opening, a chamber, said chamber adjoining said pressure compensating plate circumferentially surrounding said central opening spaced therefrom, a seal, said seal sealing between said central opening and said chamber and passage means to fluidically connect said chamber to the unidirectional passage in the manifold.

32. The pressure compensating mechanism of claim 31 characterized by the addition of an end plate, said end plate being fixed to said pressure compensating plate on the opposite side of the manifold and said chamber being between said pressure compensating plate and said end plate.

33. The pressure compensating mechanism of claim 31 characterized in that said passage means includes a check valve to retain the relatively high pressure in said chamber.

34. The pressure compensating mechanism of claim 31 wherein the manifold is a brazed multiplate manifold and characterized in that said pressure compensating plate is fixed to the manifold by brazing.

35. The pressure compensating mechanism of claim 31 characterized by the addition of pressure relief means to relieve the pressure in said chamber when the device is non-operational.

36. The pressure compensating mechanism of claim 35 wherein the device includes unidirectional passages connected to a port and characterized in that said pressure relief means connects to a unidirectional passage.

37. A pressure compensating mechanism for a hydraulic motor having a brazed multiplate manifold fixed to the housing of such motor next to a gerotor structure, the manifold including a unidirectional passage subject to relatively high pressure, a pressure compensating plate, said pressure compensating plate being directly fixed to the manifold by brazing on the opposite side from the gerotor structure, said pressure compensating plate having a central opening, an end plate, said end plate being fixed to said pressure compensating plate on the opposite side from the manifold, a chamber, said chamber being in a circumferential groove in said end plate circumferentially surrounding said central opening, a seal, said seal sealing between said central opening and said chamber, passage means to fluidically connect said chamber to the unidirectional passage, said passage means including a check valve, and said check valve retaining the relatively high pressure in said chamber.

38. The pressure compensating mechanism of claim 37 characterized by the addition of pressure relief means to relieve the pressure in said chamber when the pressure in the bidirectional passages is reduced.

39. A pressure compensating mechanism for a hydraulic motor having a manifold fixed to the housing of such motor next to a gerotor structure, the manifold including bidirectional valving passages occasionally subject to relatively high pressure, a pressure compensating plate, said pressure compensating plate being fixed to the manifold on the opposite side from the gerotor structure, said pressure compensating plate having a central opening, a chamber, said chamber adjoining said pressure compensating plate circumferentially surrounding said central opening spaced therefrom, a seal, said seal sealing between said central opening and said chamber and passage means to fluidically connect said chamber to the bidirectional valving passages.

40. The pressure compensating mechanism of claim 39 characterized by the addition of an end plate, said end plate being fixed to said pressure compensating plate on the opposite side of the manifold and said chamber being between said pressure compensating plate and said end plate.

41. The pressure compensating mechanism of claim 39 characterized in that said passage means includes a check valve to retain the relatively high pressure in said chamber.

42. The pressure compensating mechanism of claim 39 wherein the manifold is a brazed multiplate manifold and characterized in that said pressure compensating plate is fixed to the manifold by brazing.

43. The pressure compensating mechanism of claim 39 characterized by the addition of pressure relief means to relieve the pressure in said chamber when the device is non-operational.

44. The pressure compensating mechanism of claim 43 wherein the device includes unidirectional passages connected to a port and characterized in that said pressure relief means connects to a unidirectional passage.

45. A pressure compensating mechanism for a hydraulic motor having a brazed multiplate manifold fixed to the housing of such motor next to a gerotor structure, the manifold including bidirectional valving passages occasionally subject to relatively high pressure, a pressure compensating plate, said pressure compensating plate being directly fixed to the manifold by brazing on the opposite side from the gerotor structure, said pressure compensating plate having a central opening, an end plate, said end plate being fixed to said pressure compensating plate on the opposite side from the manifold, a chamber, said chamber being in a circumferential groove in said end plate circumferentially surrounding said central opening, a seal, said seal sealing between said central opening and said chamber, passage means to fluidically connect said chamber to the bidirectional valving passages, said passage means including a check valve, and said check valve retaining the relatively high pressure in said chamber.

46. The pressure compensating mechanism of claim 45 characterized by the addition of pressure relief means to relieve the pressure in said chamber when the pressure in the bidirectional passages is reduced.

47. A wear mechanism for a hydraulic motor including driveshaft with a thrust bearing to the housing of the motor and an end, the motor having an orbiting rotor, the wear mechanism comprising the end of the driveshaft being near to the orbiting rotor, a thrust washer, and said thrust washer being directly between the end of the driveshaft and the orbiting rotor in contact with both.

48. An equalizing mechanism for a rotor valved gerotor device, such rotor having a central opening on both sides thereof, the equalization mechanism comprising the central opening being enlarged on one side of the rotor in respect to the other side, independent holes, said independent holes being in the other side of the rotor, and means to individually pressurize said independent holes when the enlarged central opening is pressurized.

* * * * *